US011213936B2

(12) United States Patent
Chen

(10) Patent No.: US 11,213,936 B2
(45) Date of Patent: Jan. 4, 2022

(54) TORQUE ADJUSTMENT SWITCHING STRUCTURE OF TORQUE WRENCH

(71) Applicant: Di-Jen Chen, Taichung (TW)

(72) Inventor: Di-Jen Chen, Taichung (TW)

( * ) Notice: Subject to any disclaimer, the term of this patent is extended or adjusted under 35 U.S.C. 154(b) by 203 days.

(21) Appl. No.: 16/691,124

(22) Filed: Nov. 21, 2019

(65) Prior Publication Data

US 2020/0246947 A1 Aug. 6, 2020

(30) Foreign Application Priority Data

Feb. 1, 2019 (TW) ..... 108104035

(51) Int. Cl.
*B25B 23/142* (2006.01)

(52) U.S. Cl.
CPC ..... *B25B 23/1427* (2013.01)

(58) Field of Classification Search
CPC ..... B25B 23/1427
USPC ..... 81/52, 483, 478
See application file for complete search history.

(56) References Cited

U.S. PATENT DOCUMENTS 7,044,036 B1 * 5/2006 Salazar ..... B25B 23/1427 81/478
2018/0141193 A1 * 5/2018 Chen ..... B25B 23/1427

* cited by examiner

*Primary Examiner* — Joseph J Hail
*Assistant Examiner* — Caleb Andrew Holizna
(74) *Attorney, Agent, or Firm* — Egbert, McDaniel & Swartz, PLLC

(57) ABSTRACT

A torque adjustment switching structure of a torque wrench is characterized by: a screw hole seat, which is located in the rear section of the torque wrench extension shank; the axial actuating sleeve can be axially advanced and retracted; the rear pull sleeve can be forced against the axial actuating sleeve. The axial movement and the rotary motion: the clutch member has a snapping mode and a disengagement mode with the sliding forward and backward of the backward pulling sleeve; and the rearward pulling sleeve presents a force for axial advance and retreat with respect to a screw, and rotates. The timing mechanism is configured to drive the synchronous rotation of the screw. The limiting member is disposed at a corresponding portion of the screw and the rear sliding sleeve to generate a limiting force for the axial backward sliding state of the backward pulling sleeve.

12 Claims, 7 Drawing Sheets

TORQUE ADJUSTMENT SWITCHING STRUCTURE OF TORQUE WRENCH

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a partial structure of a torque wrench, and more particularly to a torque adjustment switching structure of a torque wrench.

2. Description of Related Art Including Information Disclosed Under 37 CFR 1.97 and 37 CFR 1.98

A torque wrench usually has a torque adjustment structural unit to adjust the maximum torque load value of the torque wrench, so that the torque wrench has the safety protection function when overload tripping.

The torque wrench adjustment structure is generally used to adjust the spring force of a spring disposed inside the torque wrench grab handle (for example, the greater the degree of compression, the greater the torque), thereby achieving the purpose of adjusting the torque; the adjustment component of the torsion adjustment structure is often disposed at the tail end of the grab handle of the torque wrench, and when the torque is to be adjusted, the hand tool or the other hand must be used to assist in the torque adjustment, so the convenience of use is a little inadequate. Improving on this defect is an important technical issue that the industry is concerned about.

BRIEF SUMMARY OF THE INVENTION

The main purpose of the invention is to provide a torque adjustment switching structure of a torque wrench. The technical problem to be solved is to develop a new torque adjustment switching structure of torque wrench with more convenient operation and more ideal practicability for innovation and breakthrough. The torque adjustment switching structure is used for adjusting the pushing force of the spring set inside the rear section of the extension handle of torque wrench and switches its adjusting opening and closing mode.

Based on said purpose, the technical problem of the present invention to be solved mainly aims at that the torque adjustment switching structure includes: a screw hole seat disposed inside the rear section of the extension handle in the positioning state, and the screw hole seat is provided with a guide screw hole axially penetrated along the extension shaft of the extension handle; an axial actuating sleeve with an open-shaped sleeve end and a rear end wall, wherein the open-end sleeve provided with the end sleeve set is disposed on the outer circumference of the rear section of the extension handle to be axially slid forward and backward. And the axial actuating sleeve and the rear section of the extension handle are provided with an axial movement limiting member that cooperates with each other to restrict the axial actuating sleeve that only perform axial displacement movement of the limited stroke but cannot be rotated, and the rear end wall is provided with a penetration guide hole; a pull-back rotating sleeve is provided with a sliding sleeve hole groove and a tail end wall, wherein the sliding sleeve hole groove is sleeved outside the axial actuating sleeve, so that the pull-back rotating sleeve can be axially slid relative to the axial actuating sleeve under the force, the tail end wall is opposite to the rear end wall of the axial actuating sleeve, and the tail end wall is provided with a through open which is opposite to the penetration guide hole disposed at the rear end wall of the axial actuating sleeve; a clutch member includes a tail end wall disposed at pull-back rotating sleeve and a first clutch member and a second clutch member corresponding to the rear end wall of the axial actuating sleeve, and the first clutch member and the second clutch member are in the forward and backward state along with sliding of the sliding-back rotating sleeve, and have a state change of the engagement mode and disengagement mode; a screw comprises an inner end limiting part, an outer end limiting part, a threaded section, an axial moving section adjacent to the outer end limiting part, and a rotary section between the axial moving section and one end of the threaded section, wherein the threaded section is screwed to the guiding screw hole of the screw hole seat adjacent to the inner end limiting part, so that the inner end limiting part abuts against one end of the screw hole seat, and the axial moving section is provided with a through open disposed on the tail end wall of the pull-back rotating sleeve, and the axial moving section and the through open are provided with a plurality of axial bolts and a plurality of axial bolt slots matched in the ring state, so that a pull-back rotating sleeve can be axially slid forward and back ward relative to the screw, it can drive the screw to be synchronously rotated when rotating. The outer end limit part is located at a spacing position behind the through open disposed on the tail end wall. The screwing section is screwed to the through open disposed on the tail end wall of the axial actuating sleeve; a limiting member is disposed at a position of the screw corresponding to the pull-back rotating sleeve, and the limiting member generates a limiting force for the at least axial backward sliding state of the pull-back rotating sleeve.

According to the unique innovative structure and technical features, the present invention is compared with the previous technology, the torque adjustment switching structure can be adjusted by the user simply pulling back and rotating the pull back rotating sleeve in axial direction. The operation is quite simple and convenient, and no other hand tools are needed, so that the torque adjustment of the torque wrench can be switched to the practical and convenient operation.

DETAILED DESCRIPTION OF THE INVENTION

FIG. 1-FIG. 4 are the preferred embodiments of the torque adjustment switching structure of torque wrench of the present invention, but these embodiments are for illustrative purposes only, and are not limited by the structure in the patent application. The torque adjustment switching structure is used for adjusting the pushing force of a torque adjustment spring 20 disposed inside the rear section of an extension handle 10 of the toque wrenches A, and switching the opening and closing mode of the adjustment.

Figure 1:
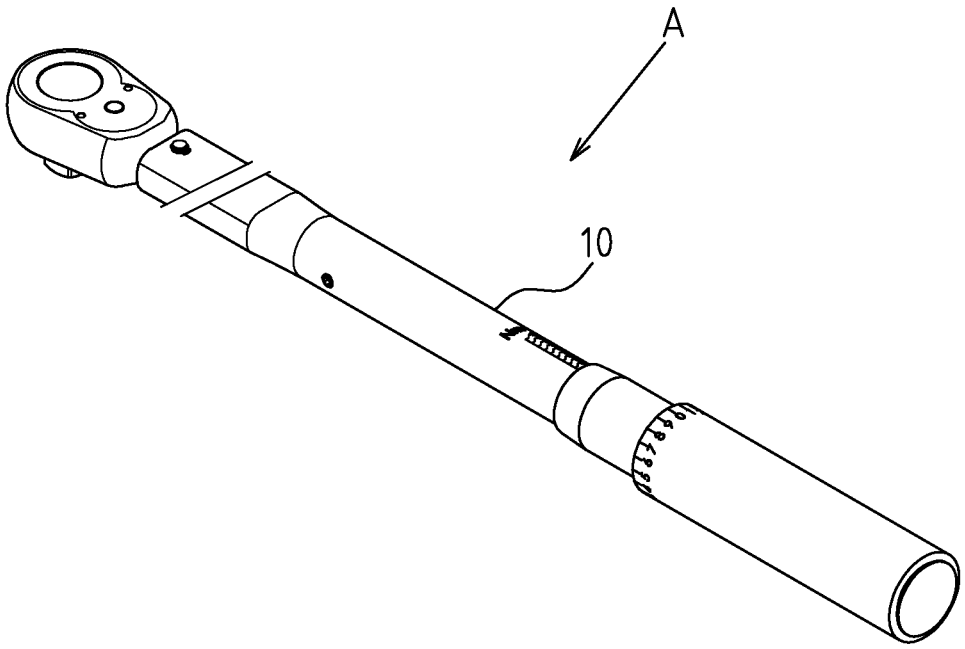
FIG. 1 is a combined three-dimensional diagram of a preferred structure embodiment of the present invention.
Figure 2:
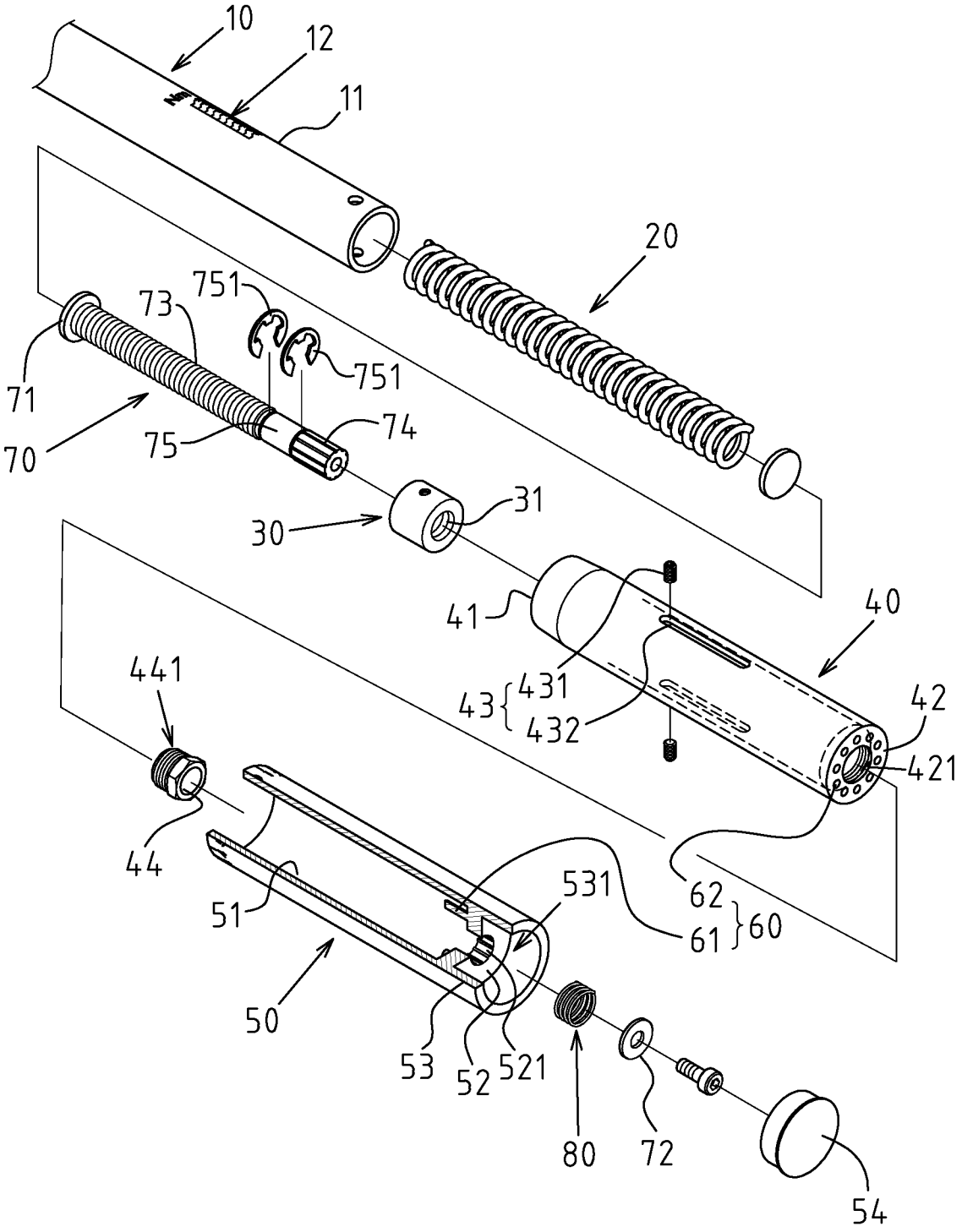
FIG. 2 is a decomposition three-dimensional diagram of a preferred structure embodiment of the present invention.

The torque adjustment switching structure includes the following structure: a screw hole seat 30 is disposed inside the rear section 11 of the extension handle 10 in the positioning state, and the screw hole seat 30 is provided with a guiding screw hole 31 penetrated along the extension axial direction of the extension handle 10; an axial actuating sleeve 40 includes an open sleeve end 41 and a rear end wall 42, wherein the open sleeve end 41 is sleeved on the outer periphery of the rear section 11 of the extension handle 10 in the axially sliding forward and backward state under the force, and the axial actuating sleeve 40 and the rear section 11 of the extension handle 10 are provided with an axial movement limiting member 43 matched with each other to limit the axial displacement movement of the axial actuating sleeve 40 of the limited stroke but cannot be rotated, the rear end wall 42 is provided with a penetration guide hole 44. In the specific embodiment, the penetration guide hole 44 is disposed in a nut 441, so that the rear end wall 42 is provided with a screw hole 421 for the nut 441 to be screwed and positioned; a pull-back rotating sleeve 50 is provided with a sliding sleeve hole groove 51 and a tail end wall 52, wherein the sliding sleeve hole groove 51 is sleeved outside the axial actuating sleeve 40, so that the pull-back rotating sleeve 50 can be axially moved and rotated relative to the axial actuating sleeve 40 under the force. The tail end wall 52 is spaced apart from the rear end wall 42 of the axial actuating sleeve 40, and the tail end wall 52 is provided with a through open 521, and the through open 521 is opposite to the penetration guide hole 44 disposed on the rear end wall 42 of the axial actuating sleeve 40; a clutch member 60 includes a tail end wall 52 disposed in the pull-back rotating sleeve 50, and a first clutch member 61 and a second clutch member 62 corresponding to a rear end wall 42 of the axial actuating sleeve 40, the first clutch member 61 and the second clutch member 62 have a state change of the engagement mode and disengagement mode as the pull-back rotating sleeve 50 slides forward and backward; a screw 70 comprises an inner end limiting part 71, an outer end limiting part 72, a threaded section 73, an axially moving section 74 adjacent to the outer end limiting part 72, and a screwing section 75 between the axially moving section 74 and the threaded section 73, wherein the threaded section 73 is screwed to the guiding screw hole 31 of the screw hole seat 30 adjacent to the inner end limiting part 71, and the inner end limiting part 71 abuts against one end of the screw hole seat 30, and the axially moving part 74 passes through the through open 521 disposed on the tail end wall 52 of the pull-back rotating sleeve 50, and the axially moving part 74 and the through open 521 are provided with a plurality of axial bolts and a plurality of axial bolt slots matched in the ring state, the pull-back rotating sleeve 50 can be axially slid forward and backward relative to the screw 70, it can drive the screw 70 to be synchronously rotated in a coordinated relationship when rotating, the outer end limiting part 72 is located at a spacing position behind the through open 521 disposed on the tail end wall 52, and the screwing section 75 is screwed in a penetration guide hole 44 disposed on the rear end wall 42 of the axial actuating sleeve 40; a limiting member 80 is disposed at a position of the screw 70 corresponding to the pull-back rotating sleeve 50, and the limiting member 80 generates a limit function on the at least axial backward sliding state of the pull-back rotating sleeve 50. As shown in FIG. 2, the limiting member 80 is a spring assembly type (shown as a coil spring in the figure) which is elastically supported between the tail end wall 52 of the pull-back rotating sleeve 50 and the outer end limit part 72 of the screw 70, the pull-back rotating sleeve 50 for axially backward sliding generates a limit action force for elastic forward automatic reset.

Figure 3:
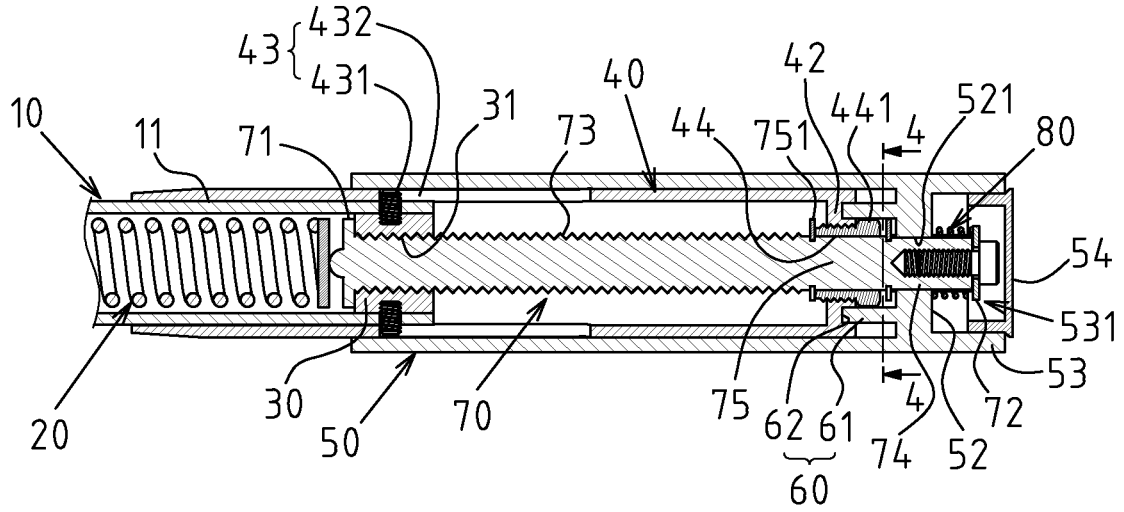
FIG. 3 is a sectional view of a partial structure combination of the present invention.
Figure 4:
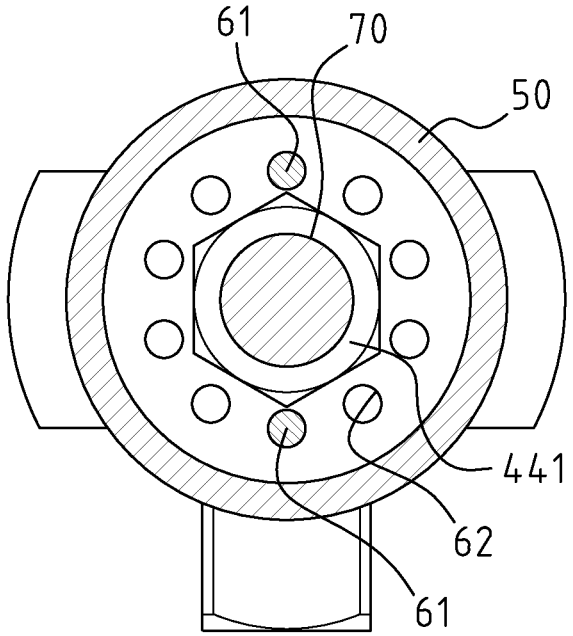
FIG. 4 is a 4-4 sectional view of FIG. 3.

Wherein, the screw hole seat 30 and the rear section 11 of the extension handle 10 are in a combined type or an integrated type relationship; this part is the screw hole seat 30 as shown in FIG. 3, it and the rear section 11 of the extension handle 10 form the combined relationship.

As shown in FIG. 2, in this embodiment, the axial movement limiting member 43 includes two headless bolts 431 which are screwed to the screw hole seat 30 and protruded from two opposite sides of the rear section 11 of the extension handle 10, and two axial long holes 432 are respectively disposed on two opposite sides of the axial actuating sleeve 40, so that the two headless bolts 431 are respectively protruded in the two axial long holes 432.

As shown in FIG. 2, in this embodiment, the first clutch member 61 of the clutch member 60 is disposed inside the tail end wall 52 of the pull-back rotating sleeve 50 in the plural protruding stud shape, and the second clutch member 62 is disposed on the rear end wall 42 of the axial actuating sleeve 40 in the plural recessed hole shape. When the pull-back rotating sleeve 50 is rotated relative to the axial actuating sleeve 40, the plural protruding studs are selectively relative to the plural recessed holes in the several recessed holes; in this embodiment, the protruding stud combined with the recessed hole used in the first clutch member 61 and the second clutch member 62 can achieve a relatively stable and reliable locking effect and prevent the arbitrarily disengage between two ones after positioning.

As shown in FIG. 2, in this embodiment, a torque value scale 12 is further provided outside the rear section 11 of the extension handle 10 is further provided with a torque value scale of 12.

As shown in FIG. 2, in this embodiment, two fasteners 751 disposed with interval are provided outside the screwing part 75 of the screw 70, and the two fasteners 751 form the limiting effect respectively on two opposite ends of the nut 441; The purpose of the nut 441 set in this embodiment is mainly to achieve the function of fine-tuning the accurate value of the torsion scale by adjusting forward and backward the position.

As shown in FIGS. 2, 3, in this embodiment, the periphery behind the rear end wall 52 disposed in the pull-back rotating sleeve 50 is further extended to form an enclosure frame 53, and an accommodating space 531 is formed inside the enclosure frame 53 for accommodating the outer end limiting part 72 of the screw 70 and the elastic component therein, the enclosure frame 53 has a rear end opening, and the rear end opening is closed by a movable cover 54.

As shown in FIGS. 2 and 3, in this embodiment, the axial movement limiting member 43 includes two headless bolts 431 that are screwed into the screw hole seat 30 and protruded from two opposite sides of the rear section of the extension handle 10, and two axial long holes 432 that are respectively disposed on two opposite sides of the axial actuating sleeve 40, so that two headless bolts 431 are respectively protruded into two axial long holes; and wherein the headless bolt 431 and the axial long hole 432 are covered by the pull-back rotating sleeve 50 in a hidden state, thereby preventing dust to affect the smoothness of the components and the accuracy of the scale, accordingly prolonging the service life of the related components.

Figure 5:
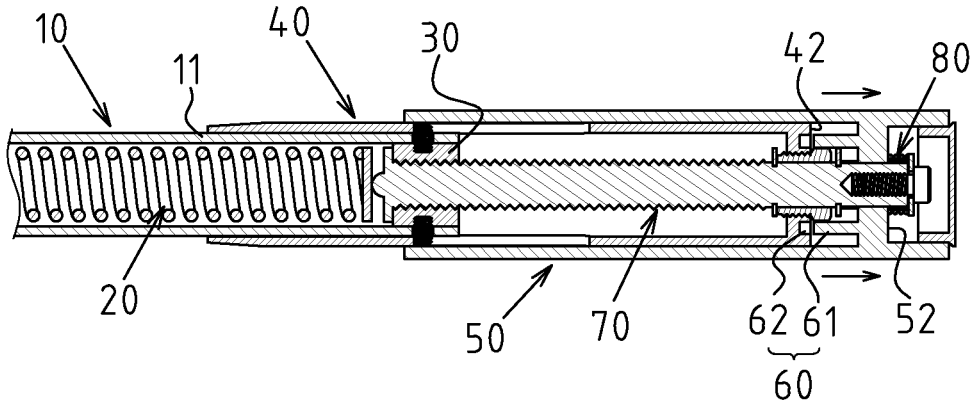
FIG. 5 is a sectional view of pull-back rotating sleeve of the present invention in the sliding-back state.
Figure 6:
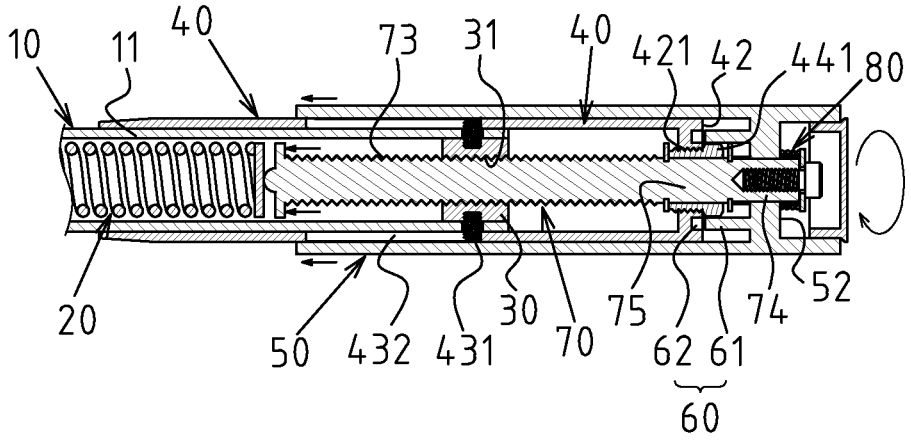
FIG. 6 is a sectional view of pull-back rotating sleeve of the present invention in the rotary torque adjustment state.
Figure 7:
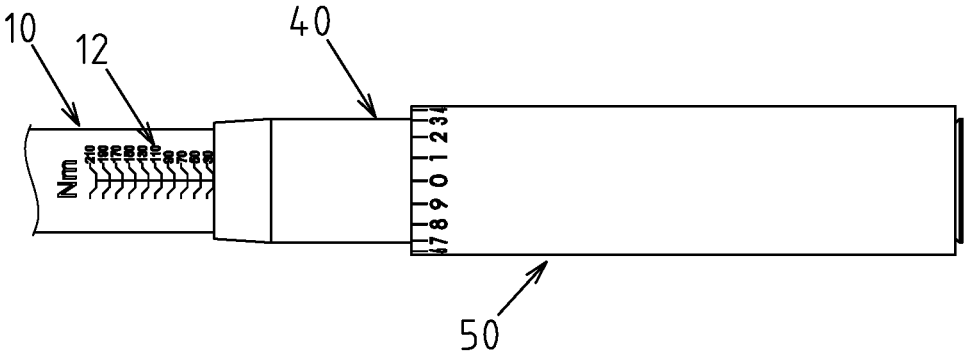
FIG. 7 is a side view 1 of the torque value scale position of the present invention.
Figure 8:
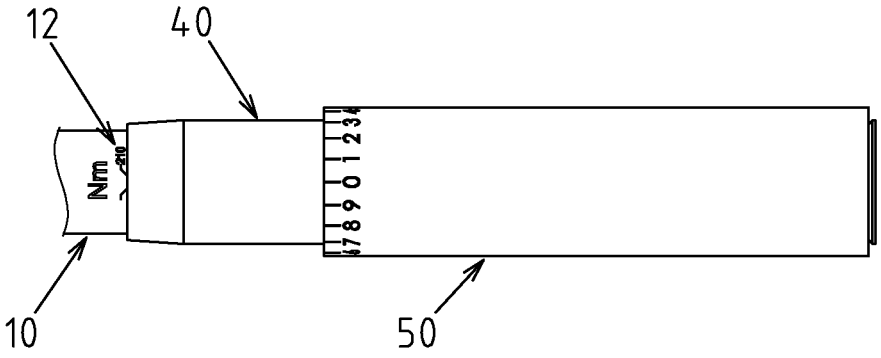
FIG. 8 is a side view 2 of the torque value scale position of the present invention.

With the above structural composition and technical features, the operation of the preferred embodiment of the present invention will be described as follows: as shown in FIGS. 5 and 7, when the pull-back rotating sleeve 50 is pulled axially backward, the limiting member 80 will be compressed to accumulate the return elastic force, and at this time, the first clutch member 61 disposed on the tail end wall 52 of the pull-back rotating sleeve 50 will be disengaged from the second clutch member 62 disposed on the rear end wall 42 of the axial actuating sleeve 40, and the torque value scale 12 shown outside the extension handle 10 is in the minimum torque value state at this time; then, as shown in FIGS. 6 and 8, since the first clutch member 61 and the second clutch member 62 are in the disengaged state, so the pull-back rotating sleeve 50 is released to be capable of rotating relative to the axial actuating sleeve 40 to drive the screw 70 to be rotated synchronously. Since the axial actuating sleeve 40 can only generate the axial movement, when the screw 70 is rotated, the axial actuating sleeve 40 will be axially moved forward and backward due to the screwing relationship between the screw hole 421 and the screw 70 provided on the rear end wall 42. In the state disclosed in FIG. 6, the screw 70 is moved toward the left side of the figure, so that the torque adjustment spring 20 is extruded to cause an adjustment state in which the torque is increased, and the torque value scale 12 shown at this time is as shown in FIG. 8. When the torque adjustment operation is completed, the user can release the pulling force on the pull-back rotating sleeve 50, and then the pull-back rotating sleeve 50 can be reset forward by the elastic release action of the limiting member 80, and the pull-back rotating sleeve 50 is locked again by the engagement state of the first clutch member 61 and the second clutch member 62. It can be seen that on the operation of the torque adjustment switching structure exposed in the present invention, the user is only required to adjust by axially the pulling backing and rotating the pull-back rotating sleeve 50, and the operation is quite simple and convenient. There is no need to use other hand tools for assistance, and the torque adjustment switching operation convenience of the torque wrench can be greatly improved.

Figure 9:
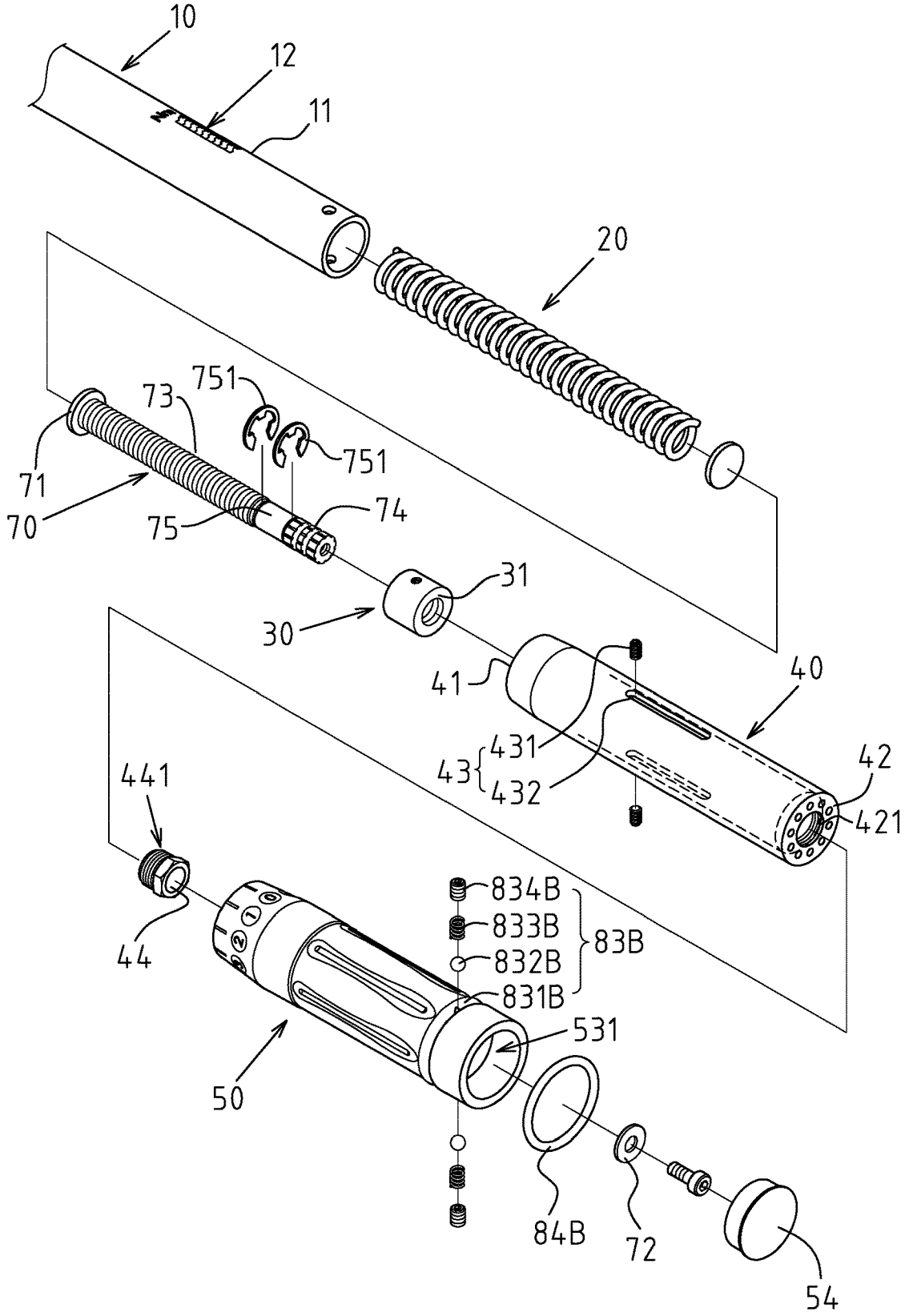
FIG. 9 is a decomposition three-dimensional diagram of another embodiment of the present invention.
Figure 10:
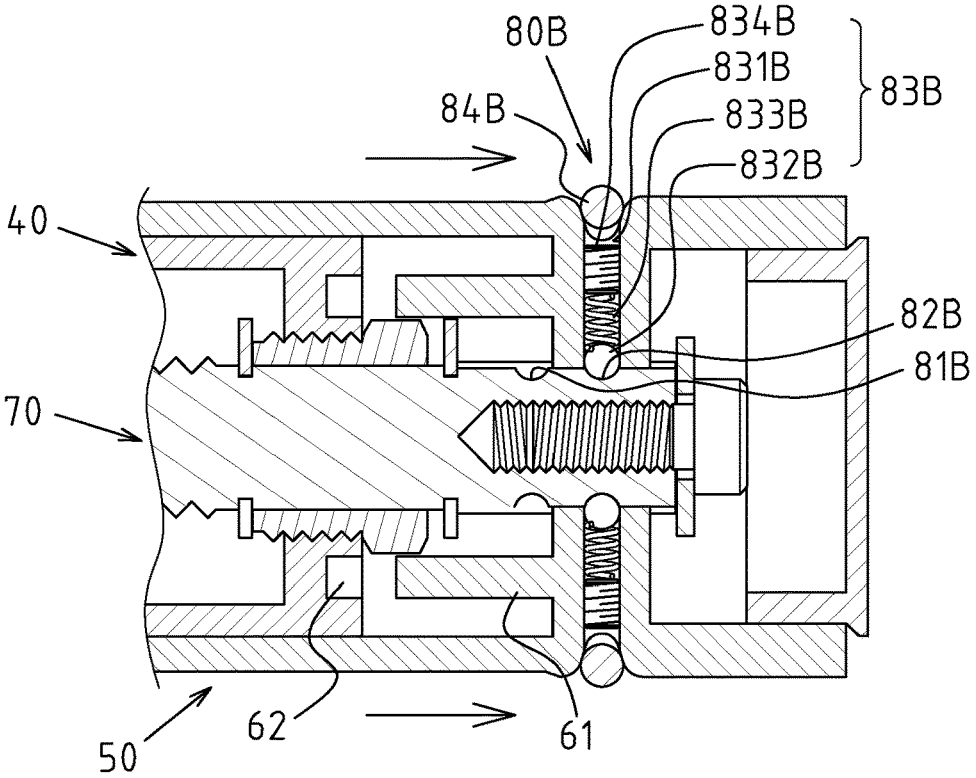
FIG. 10 is a sectional view of pull-back rotating sleeve of the exposed embodiment of FIG. 9 in the sliding-back state.
Figure 11:
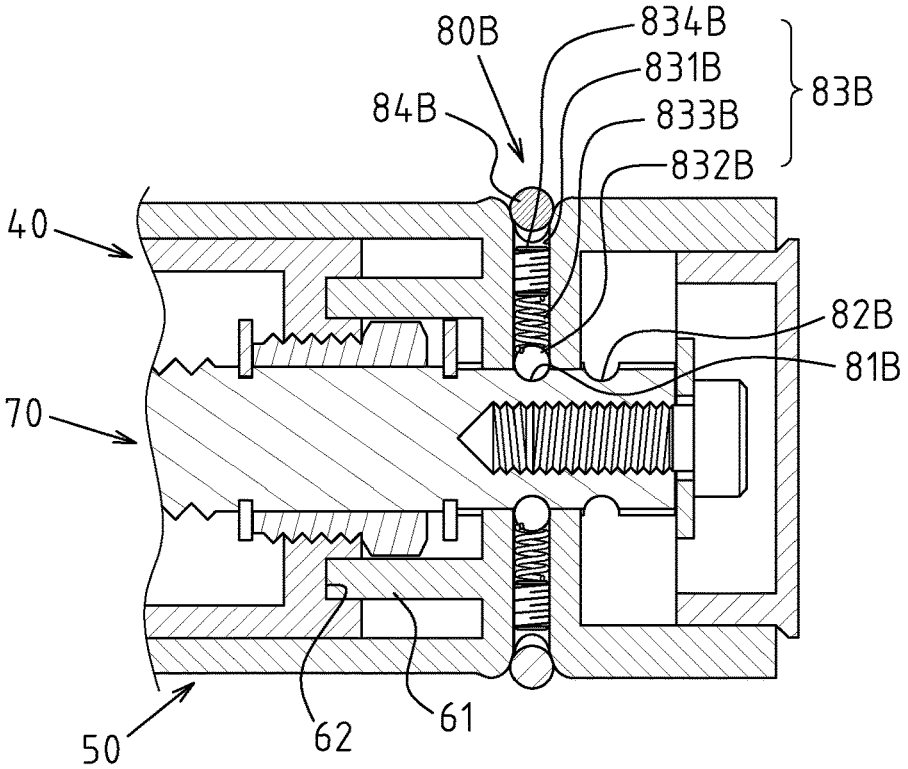
FIG. 11 is a sectional view of pull-back rotating sleeve of the exposed embodiment of FIG. 9 in the sliding-forward state.

As shown in FIG. 9-FIG. 11, in this embodiment, the limiting member 80B is in a sectional engaging and positioning structure state, including a front section positioning annular groove 81B and a rear section positioning annular groove 82B of the screw 70 adjacent to its outer end limiting part 72 in a front-to-back spacing configuration relationship, and at least one elastic bead assembly 83B disposed at a corresponding position of the pull-back rotating sleeve 50, wherein each elastic bead assembly 83B includes a radial groove 831B disposed in the pull-back rotating sleeve 50, a bead 832B disposed in an inner end of the radial groove 831B and a elastic member 833B for elastically pushing inward the bead 832B; when the pull-back rotating sleeve 50 is in a backward sliding state (as shown in FIG. 10), the bead 832B of the elastic bead assembly 83B is in a state of being engaged with the rear section positioning annular groove 82B; when the pull-back rotating sleeve 50 is in the forward sliding reset state (as shown in FIG. 11), the bead 832B of the elastic bead assembly 83B is engaged with the front section positioning annular groove 81B. The present embodiment mainly illustrates that when the pull-back rotating sleeve 50 is in an axial moving state, the bead 832B of the elastic bead assembly 83B is aligned and engaged with the front section positioning annular groove 81B or the rear section positioning annular groove 82B, so as to achieve two-stage positioning effect.

As shown in FIGS. 10 and 11, in this embodiment, an annular groove is disposed the outer circumference of the pull-back rotating sleeve 50 corresponding to each elastic bead assembly 83B, and an elastic ring 84B is sleeved in the annular groove; in this embodiment, the purpose of adding the elastic ring 84B mainly aims to cover and hide the elastic bead assembly 83B and has an aesthetic decorative effect.

As shown in FIGS. 10 and 11, in this embodiment, each elastic bead assembly 83B further includes a positioning pin 834B that is screwed into the outer end of the radial groove 831B for limiting the bead 832B and the elastic member 833B.

I claim:

1. A torque adjustment switching mechanism comprising:

a torque wrench having a torque adjustment spring disposed inside a rear section of an extension handle thereof;

a screw hole seat disposed inside the rear section of the extension handle in a positioning state, the screw hole seat having a guiding screw hole extending along an axial direction of the extension handle;

an actuating sleeve having an open end and a rear end, wherein the actuating sleeve is sleeved on an outer periphery of the rear section of the extension handle and slidable forwardly and backwardly thereon, wherein said actuating sleeve and the rear section of the extension handle have a movement limiting member that cooperates with said actuating sleeve and the rear section of the extension handle so as to limit said actuating sleeve to only axial displacement of a defined length without rotation, the rear end of said actuating sleeve having a wall with a guide hole formed through the wall;

a pull-back rotating sleeve having a sliding sleeve hole groove and a tail end wall, wherein the sliding sleeve hole groove is sleeved on an exterior of said actuating sleeve such that said pull-back rotating sleeve is movable axially and rotatably relative to said actuating sleeve, the tail end wall being spaced from the wall at the rear end of said actuating sleeve, the tail end wall having a through opening opposite to the guide hole at the wall at the rear end of said actuating sleeve;

a clutch member having a tail end wall disposed in said pull-back rotating sleeve, said clutch member having a first member and a second member corresponding to the wall at the rear end of said actuating sleeve, the first member and the second member being slidable forwardly and backwardly along said pull-back rotating sleeve so as to have an engagement mode and a disengagement mode;

a screw having an inner end limiting part and an outer end limiting part and a threaded section and an axial moving section adjacent to the outer end limiting part and a screwing section positioned between the axial moving section and one end of the threaded section, wherein the threaded section is screwed into the guiding screw hole of said screw hole seat adjacent to the inner end limiting part, the inner end limiting part abutting one end of said screw hole seat, wherein the axial moving section extends through the through opening of the tail end wall of said pull-back rotating sleeve, the axial moving section and the through opening having a plurality of bolts and a plurality of bolt slots arranged in a ring configuration, said pull-back rotating sleeve being axially slidable forwardly and backwardly relative to said screw so as to rotatably drive said screw synchronously with said pull-back rotating sleeve, wherein the outer end limiting part is positioned behind the through opening of the tail end wall of said pull-back rotating sleeve, the screwing section being screwed to the guide hole of said actuating sleeve; and a limiting member disposed at a position of said screw corresponding to said pull-back rotating sleeve, said limiting member resisting a backward sliding movement of said pull-back rotating sleeve.

2. The torque adjustment switching mechanism of claim 1, wherein said limiting member is an elastic member that is elastically supported between the tail end wall of said pull-back rotating sleeve and the inner end limiting part and the outer end limiting part of said screw.

3. The torque adjustment switching mechanism of claim 2, wherein said limiting member has a pair of headless bolts screwed to the screw hole seat and protrudes from opposite sides of the rear section to the extension handle, wherein the axial actuating sleeve has a pair of elongated holes respectively disposed on opposite sides thereof, the pair of headless bolts extending into the pair of elongated holes, said pull-back rotating sleeve covering the pair of headless bolts.

4. The torque adjustment switching mechanism of claim 1, wherein said screw has a front section positioning annular groove and a rear section positioning annular groove adjacent to the outer end limiting part, at least one elastic bead assembly being disposed on said pull-back rotating sleeve, wherein the at least one elastic bead assembly has a radial groove disposed on said pull-back rotating sleeve and a bead disposed in an inner end of the radial groove and an elastic member cooperative with the bead so as to urge the bead inwardly, the bead being engaged in the rear section positioning annular groove when said pull-back rotating sleeve is moved backwardly, the bead being engaged in the front section positioning annular groove when said pull-back rotating sleeve is moved forwardly.

5. The torque adjustment switching mechanism of claim 4, wherein the at least one elastic bead assembly further comprises a positioning pin screwed on an outer end of the radial groove.

6. The torque adjustment switching mechanism of claim 5, wherein an outer circumference of said pull-back rotating sleeve has an annular groove corresponding to the at least one elastic bead assembly, the annular groove of said pull-back rotating sleeve having an elastic ring sleeved therein.

7. The torque adjustment switching mechanism of claim 4, wherein said limiting member has a pair of headless bolts screwed to the screw hole seat and protrudes from opposite sides of the rear section to the extension handle, wherein the axial actuating sleeve has a pair of elongated holes respectively disposed on opposite sides thereof, the pair of headless bolts extending into the pair of elongated holes, said pull-back rotating sleeve covering the pair of headless bolts.

8. The torque adjustment switching mechanism of claim 1, wherein the first member of said clutch member is disposed inside the tail end wall of said pull-back rotating sleeve, the second member of said clutch member being disposed on the wall at the rear end of said axial actuating sleeve.

9. The torque adjustment switching mechanism of claim 1, wherein the guide hole of said axial actuating sleeve is disposed in a nut, the wall at the rear end of said axial actuating sleeve having a screw hole in which the nut is screwed and positioned, a pair of fasteners being disposed in spaced relation outside of the screwing sections of said screw, the pair of fasteners respectively forming a stop on opposite sides of the nut.

10. The torque adjustment switching mechanism of claim 1, wherein the screw hole seat and the rear section of the extension handle are separate pieces.

11. The torque adjustment switching mechanism of claim 1, wherein the screw hole seat and the rear section of the extension handle are integrated together.

12. The torque adjustment switching mechanism of claim 1, wherein the tail end wall of said pull-back rotating sleeve extends so as to define an enclosure frame, the enclosure frame having an accommodating space therein, the accommodating space receiving the outer end limiting part of said screw and the elastic member, the enclosure frame having a rear end opening that is covered and closed by a movable cover, the rear section of the extension handle having a torque value scale disposed at an exterior thereof.

* * * * *